US008414459B2

(12) United States Patent
Hsieh

(10) Patent No.: US 8,414,459 B2
(45) Date of Patent: Apr. 9, 2013

(54) STRENGTH TRAINING CONTROL DEVICE USING MOTOR ASSEMBLED BEAM-TYPE LOAD CELL

(75) Inventor: Li-Min Hsieh, Taoyuan County (TW)

(73) Assignee: Chi Hua Fitness Co., Ltd., Taoyuan County (TW)

( * ) Notice: Subject to any disclaimer, the term of this patent is extended or adjusted under 35 U.S.C. 154(b) by 146 days.

(21) Appl. No.: 13/109,072

(22) Filed: May 17, 2011

(65) Prior Publication Data

US 2012/0231930 A1 Sep. 13, 2012

(30) Foreign Application Priority Data

Mar. 11, 2011 (TW) ..... 100204353 U

(51) Int. Cl.
*A63B 21/005* (2006.01)

(52) U.S. Cl.
USPC ..... 482/6; 482/4

(58) Field of Classification Search ..... 482/1–9, 482/79, 92–94, 98–100, 133–138, 142; 601/23, 601/33–35
See application file for complete search history.

(56) References Cited

U.S. PATENT DOCUMENTS

| | | | | |
|---|---|---|---|---|
| 7,347,806 | B2 * | 3/2008 | Nakano et al. | 482/51 |
| 2007/0004567 | A1 * | 1/2007 | Shetty et al. | 482/69 |
| 2011/0118085 | A1 * | 5/2011 | Douglas et al. | 482/5 |
| 2011/0312472 | A1 * | 12/2011 | Piaget et al. | 482/52 |

* cited by examiner

*Primary Examiner* — Loan Thanh
*Assistant Examiner* — Shila Jalalzadeh Abyane
(74) *Attorney, Agent, or Firm* — Rosenberg, Klein & Lee

(57) ABSTRACT

A strength training control device comprises: a torque source (including a base frame, a motor and a gear reduction box); a drive arm, an operating rod, and a link mechanism. A beam-type load cell is coupled to the operating rod, the link mechanism, and the drive arm for measuring the load value. An electronic meter is provided for setting a torque value, and a servo controller for comparing a load value of beam-type load cell with a set value of the electronic meter. After the difference value is adjusted, an electric current is outputted to drive the motor, and the motor torque is amplified by the gear reduction box and transmitted through the link mechanism to the operating rod, and users can obtain a torque value equal to the setting of the electronic meter.

8 Claims, 6 Drawing Sheets

STRENGTH TRAINING CONTROL DEVICE USING MOTOR ASSEMBLED BEAM-TYPE LOAD CELL

BACKGROUND OF THE INVENTION (a) Field of the Invention

The present invention relates to a strength training control device using a motor assembled beam-type load cell, and more particularly to a servo device that uses an beam-type load cell for feeding back a load value and a servo controller and comparing the load value with a set value and adjusting the load value to drive a motor, such that the exercise load can be equal to the set torque value.

(b) Description of the Related Art

In addition to a base frame and a link mechanism, exercise equipments or fitness machines for strength training generally come with a resistance device for providing an exercise load. With reference to FIGS. 1 and 2 for perspective views of a stretch trainer as disclosed in U.S. Pat. No. 7,396,319, the fitness machine of this sort comprises: a stretching part 12 disposed at the front of a seat 11 and provided for pressing a user's thighs 121 and calves 122 together; a movable inward/outward direction switch part 13 disposed at the bottom of the fitness machine, and a resistance arrangement 14 disposed on a lateral side of the fitness for providing a resistance to the load, and linked with the movable inward/outward direction switch part 13 by a cable 15. If a user's thighs and calves drive the stretching part 12 towards the interior or exterior to link the movable inward/outward direction switch part 13, then the resistance arrangement 14 will provide the exercise load to the user.

In general, the conventional resistance arrangement 14 is composed of a plurality of weights 141 stacked on top of one another and used as the exercise load, but the conventional way of providing a load has the following drawbacks:

1. The weights 141 usually come with a large volume and occupy much space, and users have to add or remove the weights 141 to adjust the exercise load, not only wasting time and efforts, but also failing to continue the exercise while making the adjustment. As a result, it is difficult to achieve the expected exercise effect.

2. The load including the weights 141 is heavy and difficult to make adjustment, and users cannot have a continuous and smooth variable load according to a set curve, and thus causing an ineffective exercise effect and incurring a potential risk of muscle injuries.

3. When the load including the weights 141 is lifted to ascend and released to descend by a transmission cable 15, a very loud sound will be produced, not only distributing others, but also irritating the exerciser. Furthermore, the transmission cable 15 must be operated with components such as a winch pulley, and thus the structure of the fitness machine becomes more complicated.

The load device of the conventional fitness machine 10 has the aforementioned drawbacks and obviously requires improvements.

Some of the conventional exercise equipments or fitness machines adopt the motor torque as a resistance control of the exercise load, and an optical chopper is linked to the motor shaft, and an optical coupler is installed at its periphery to constitute an exercise stroke sensor used for controlling the electric current of a motor and used as a curve load to achieve a purpose of successful fitness. However, the optoelectronic mechanism has a relatively large volume and takes much installation space, and it also has the disadvantages of a relatively low precision, a relatively poor durability and a relatively high manufacturing cost, so that the optoelectronic mechanism cannot be used extensively by users.

SUMMARY OF THE INVENTION

Therefore, it is a primary object of the present invention to provide a load device for strength training equipments, which uses the torque of a motor shaft to substitute traditional weights to simplify the structure of the strength training equipments, not only reducing the weight and volume of the equipments significantly, but also enhancing the silent effect.

Another object of the present invention is to integrate the accurate sensing function of an beam-type load cell to feed back a load value to a control device, correct the difference, and drive a motor to achieve the desired exercise load.

A further object of the present invention is to provide a way of setting a continuous and smooth variable load by users to achieve the best strength training effect.

In order to achieve the above-mentioned objects, the invention includes:

a) a base frame;

b) a torque source, fixed onto the base frame, and comprising a motor and a gear reduction box, wherein the motor is a brushless motor or a DC motor, and an end of the gear reduction box is coupled to the motor, and another end of the gear reduction box includes a main shaft;

c) a drive arm having a depressing surface at the top of the internal side of the top end thereof and a flange at each side of the bottom end thereof, the flange having at the center thereof a shaft hole for slipping over the main shaft;

d) an operating rod with the bottom pivotally coupled to the base frame and serving as a control element for training the muscle of an operator;

e) a link mechanism including:

i) a rocker arm with the bottom portion thereof mounted onto the operating rod such that it is driven by the operating rod;

ii) a front and a rear plate each having a central hole at the bottom thereof, respectively, such that they are pivotally coupled to the flanges at both sides of the drive arm; and iii) a connecting rod with both ends pivotably and respectively coupled to the top of the rocker arm and the top of the front and rear plates, whereby, when the operating rod is activated, the rocker arm pulls (pushes) the connecting rod to impart a rotary motion in the forward or the reverse direction to the front and rear plates;

f) a beam-type load cell secured to the side of the drive arm with one end thereof resting against the depressing surface, whereby, when the front and rear plates are reversely rotated, one end of the beam-type load cell rests against the drive arm to conduct a reverse rotation.

g) an electronic meter, fixed onto the base frame, and provided for a user to set a required torque value; and h) a servo controller, for comparing the difference between a sensed value of the beam-type load cell and a set value of the electronic meter and after the difference value is adjusted, an electric current is output to drive the motor;

wherein the torque produced by the motor is amplified by the gear reduction box to adjust the actual torque value to the desired set value; and wherein, when the operator works on the operating rod, the beam-type load cell will be activated via the link mechanism to force it to conduct an reverse rotation on the drive arm such that the torque acts on the operating rod to create a load resistance and the muscle of the operator is loaded by this resistance to achieve a desirable training effect.

DETAILED DESCRIPTION OF THE PREFERRED EMBODIMENT

Figure 6:
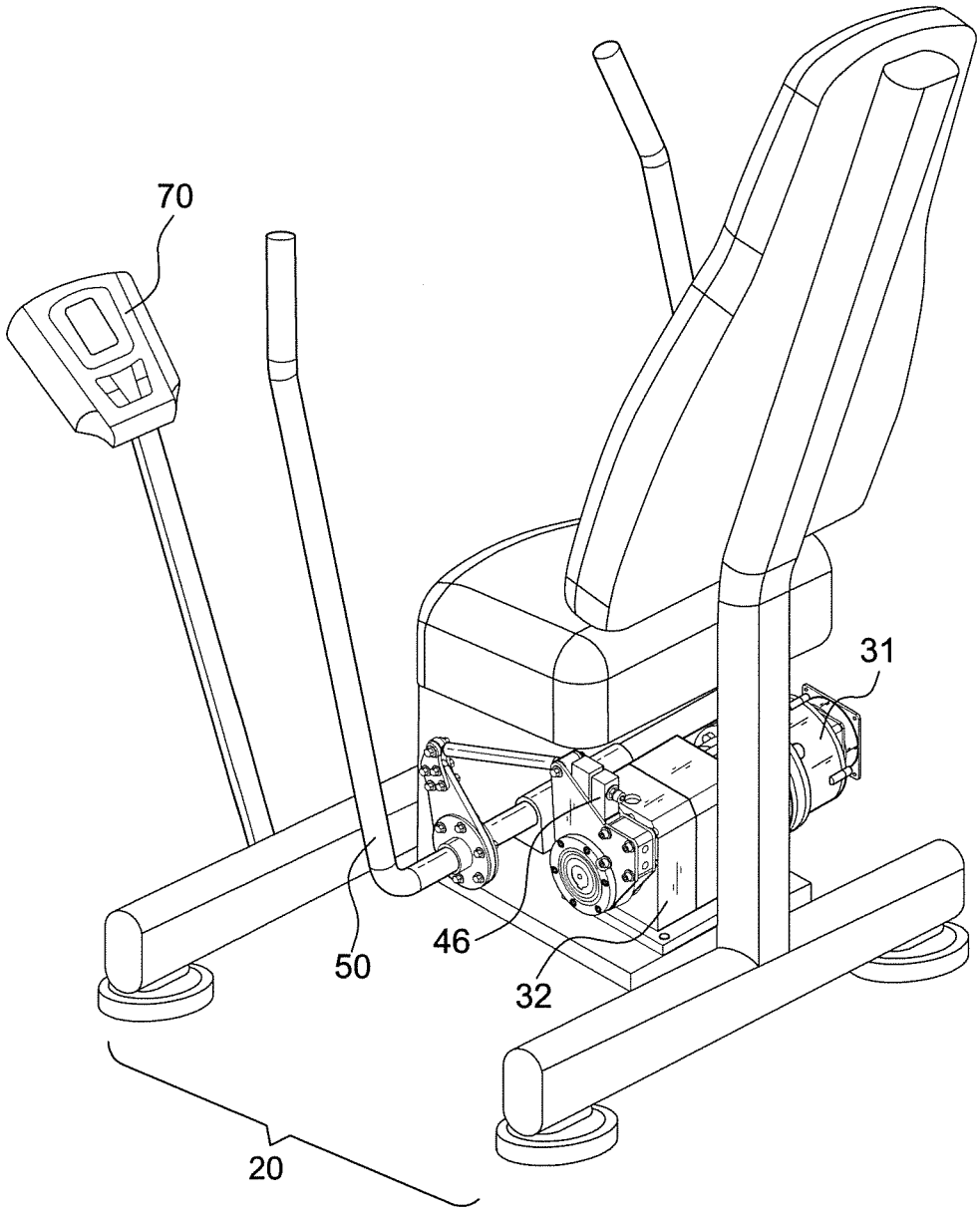
FIG. 6 is a perspective view of a preferred embodiment of the present invention applied in a fitness machine.

With reference to FIGS. 3 to 6 for a preferred embodiment of the present invention, this preferred embodiment comprises the following elements:

A base frame 20 comprises a plurality of hollow rods for installing components of the present invention, wherein the base frame is applicable for exercise equipments or medical equipments having reciprocating movements. In this preferred embodiment as shown in FIG. 6, the present invention is applied to equipments with reciprocating movements, but the present invention is not limited to such application only.

A motor 31 is a brushless motor or a DC motor for producing a load required by a linear movement of the exercise equipment.

A gear reduction box 32 with an end coupled to a shaft of the motor 31 has different sized gears, and a retardation ratio is produced by the different number of teeth of the different sized gears to increase the torque value outputted from the motor 31. The gear reduction box 32 comprises a base 321 disposed at the bottom of the gear reduction box 32 and secured onto the base frame 20 by screws, and the gear reduction box 32 further comprises a main shaft 322 disposed at another end opposite to the end coupled to the motor 31 for transmitting the increased torque value, and the main shaft 322 may have a key slot and use a key to transmit the torque. In this preferred embodiment, a square key 323 is formed directly on the main shaft 322 for coupling passive components.

An operating rod 50 comprises a right rod 51 and a left rod 52; two flanged bases 54, each being separately assembled to ends of the right rod 51 and the left rod 52 by an interference fit; and a rod holder 53, fixed onto the base frame 20 by screws or soldering, and containing an assembly for pivotally turning the rod, wherein the right rod 51 is passed through the rod holder 53, such that the operating rod 50 can be fixed to the base frame 20 and pivotally turned on the rod holder 53.

A drive arm 33 includes a depressing surface 331 at the top of the internal side of the top end thereof and a flange 332 at both sides of the bottom end thereof. The flange 332 has at the center thereof a shaft hole 333 with the diameter slightly greater than that of the flange 332. The shaft hole 333 includes internally a key slot 334 adapted to the square key 323 of the main shaft 322. The flange 332 slips over the main shaft 322 such that the drive arm 33 may drive the main shaft 322 in rotation.

A link mechanism 40 includes a rocker arm 44, a connecting rod 43, a rear plate 41, and a front plate 42. The front and rear plates 42, 41 each include a central hole 421. Six first screw holes 424 are equidistantly positioned about the circumference of the central hole 421. Besides, four first bolt holes 423 are positioned about the side of the central hole 421. In addition, a second bolt hole 422 is positioned at the top of the front and rear plates 42, 41. Two ball bearings 35 are pushed into corresponding bearing blocks 34 by use of an interference fit. Six third bolt holes 341 adapted to the first screw holes 424 are positioned about the circumference of the bearing block 34. Six first screws 67 are screwed into the third bolt holes 341 and the first screw holes 424 such that both bearing blocks 34 are mounted into the central holes 421 of the front and rear plates 42, 41. A C-shaped retaining ring 36 is mounted on the flanges 332 at both sides of the drive arm 33. Thereafter, the ball bearings 35 placed into the front and rear plates 42, 41 fit into the flanges 332 such that the front and rear plates 42, 41 is rotatable on the flanges 332. The rocker arm 44 includes six fourth bolt holes 441 at the bottom thereof. The flanged bases 54 each include six fourth bolt holes 542. Six third bolts 63 and six third nuts 631 are employed to fix the flanged bases 54 and the rocker arm 44 in place such that the rocker arm 44 can be driven by the operating rod 50 in rotation. The rocker arm 44 includes four fifth bolt holes 442 at the top thereof. Two cams 45 each have four fifth bolt holes 451. Four first bolts 61 and four first nuts 611 are employed to fix the rocker arm 44 and the cams 45 in place. The connecting rod 43 includes a second bolt holes 442 at the right end thereof. A second bolt 62 and a second nut 621 are employed to fit into the second bolt holes 422, 431 of the front and rear plates 42, 41 at the right end of the connecting rod 43 such that the right end of the connecting rod 43 is pivotable at the top of the front and rear plates 42, 41. The connecting rod 43 includes a sixth bolt holes 432 at the left end thereof. Both of the cams 45 include a sixth bolt holes 452 at the top thereof. A second bolt 62 and a second nut 621 are employed to fit into the sixth bolt holes 452, 432 of the cams 45 at the left end of the connecting rod 43 such that the left end of the connecting rod 43 is pivotable at the top of the rocker arm 44 by use of the connection with the cams 45.

A beam-type load cell 46 is secured by two second screws 65 to a load fixing block 47. Four second screw holes 471 adapted to the first bolt holes 423 of the front and rear plates 42, 41 are positioned at the front and rear sides of the load fixing block 47 such that the load fixing block 47 is screwable by four third screws 64 to the front and rear plates 42, 41. An adjusting screw 66 is positioned at the top of the beam-type load cell 46. The end of the screw rests against the depressing surface 331 of the drive arm 33. In this way, the driving force created by the operating rod 50 may be transmitted via the link mechanism 40 to the beam-type load cell 46. Moreover, the drive arm 33 may be reversed due to the depression of the adjusting screw 66.

Therefore, the torque produced by the motor 31 is retarded by the gear reduction box 32 to increase the torque value, and the torque is transmitted through the drive arm 33, the beam-type load cell 46, the front and rear plates 42, 41, the connecting rod 43, the cams 45, and the rocker arm 44 to the operating rod 50. As a result, a user can operate the operating rod by hands or legs, and the muscles of the user's hands or legs bear the torque produced by the motor and a torque value is increased by the gear reduction box the motor. In other words, the user operates the operating rod back and forth, and the motor produces a torque through the gear reduction box to produce the load resistance for the strength training.

An electronic meter 70 is fixed onto the base frame 20 and provided for users to set a desired torque value for the strength training. To improve the training effect, the invention can set a constant exercise load or set a continuous smooth variable exercise load.

Figure 1:
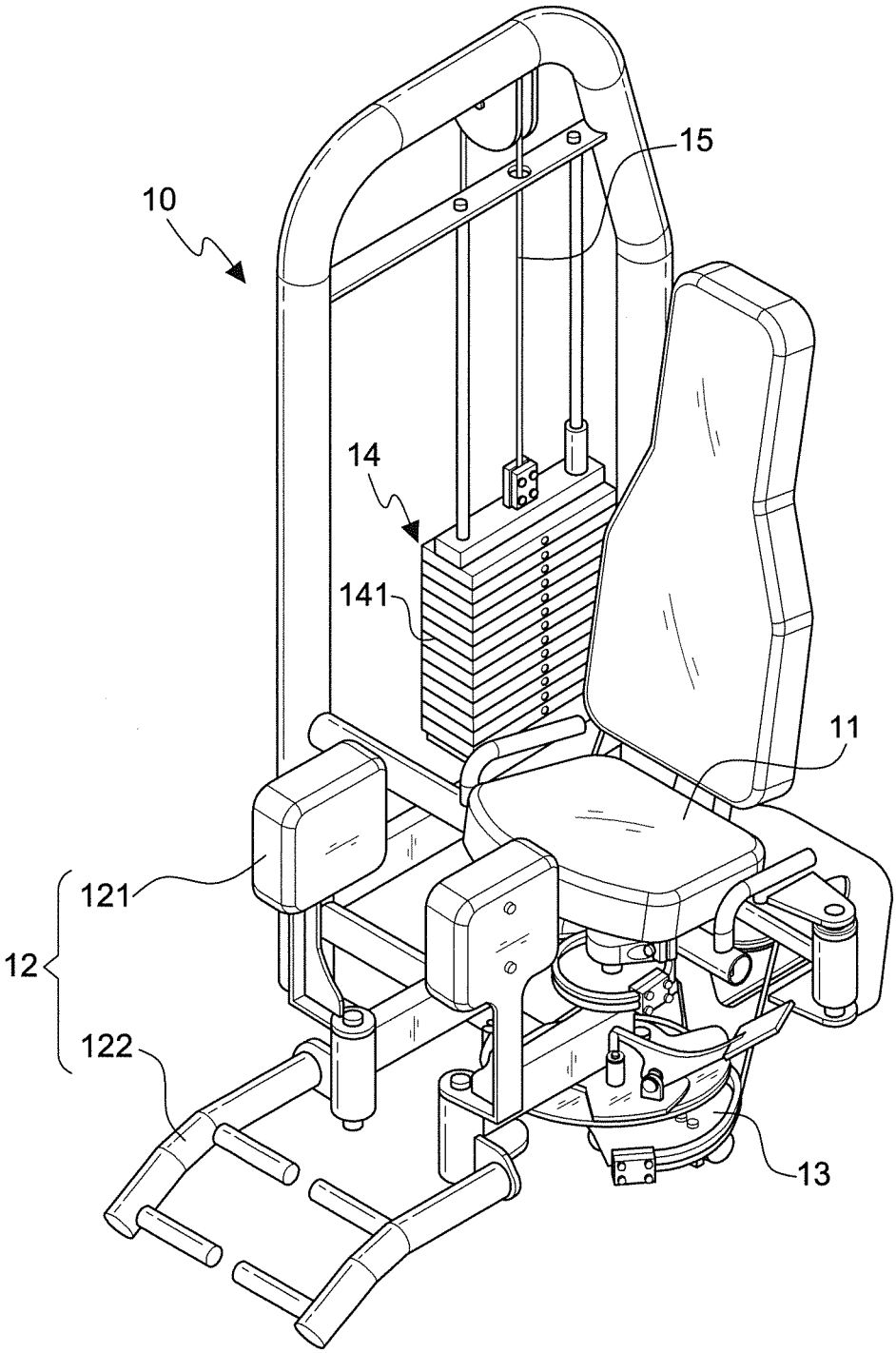
FIG.1 PRIOR ART
FIG. 1 is a first perspective view of a stretch trainer as disclosed in U.S. Pat. No. 7,396,319.
Figure 2:
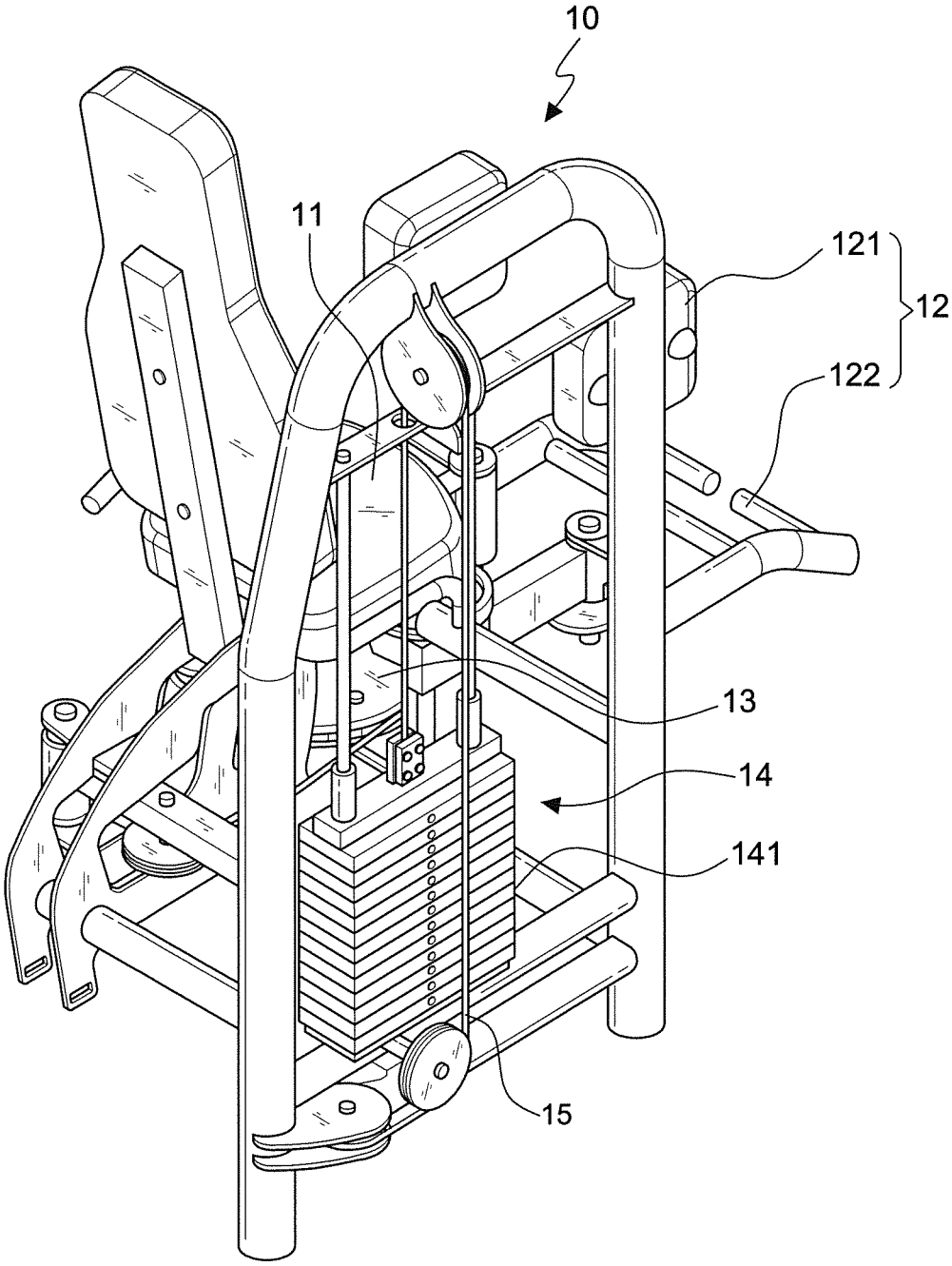
FIG.2 PRIOR ART
FIG. 2 is a second perspective view of a stretch trainer as disclosed in U.S. Pat. No. 7,396,319.
Figure 3:
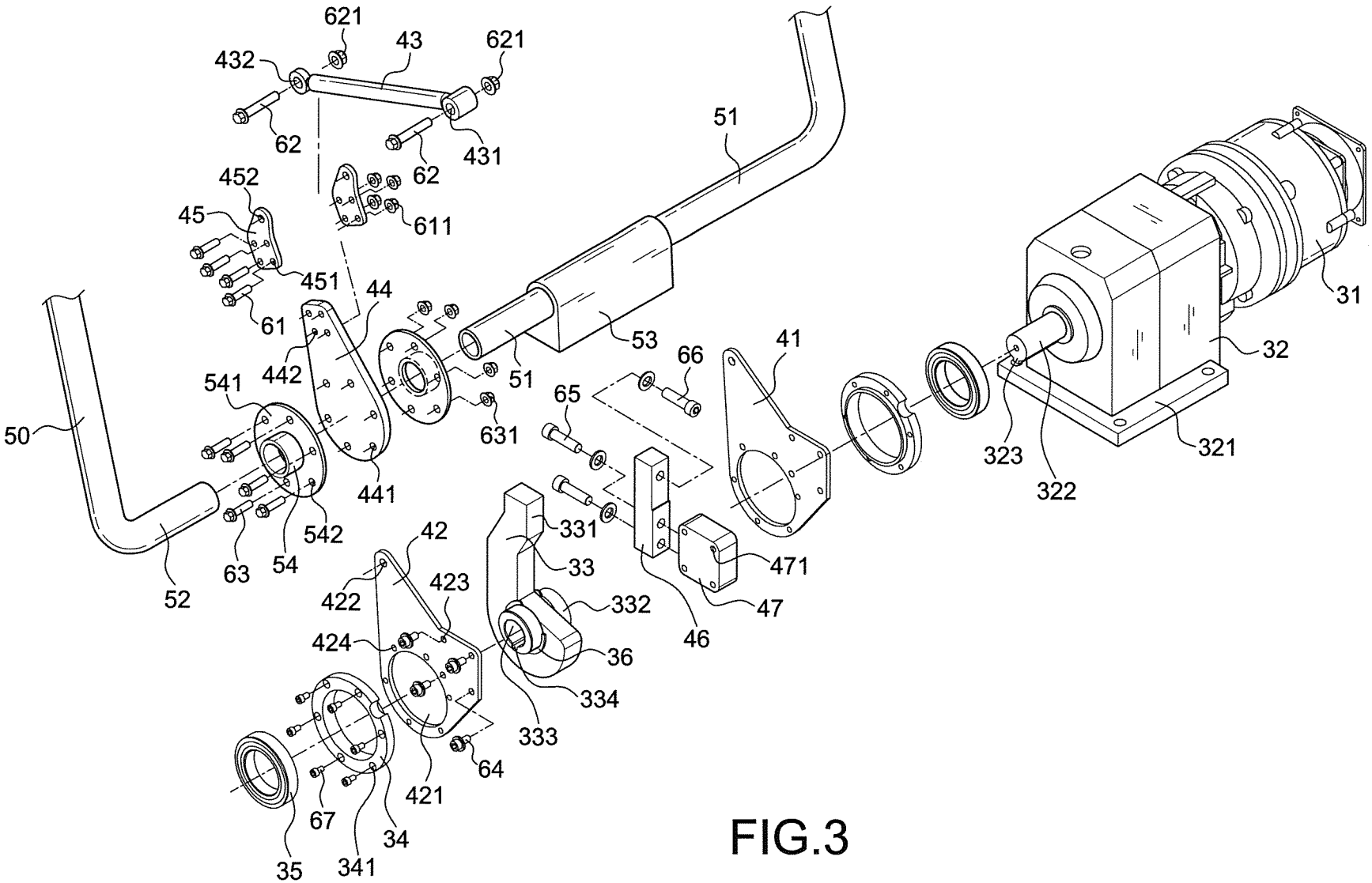
FIG. 3 is an exploded view of a preferred embodiment of the present invention.
Figure 4:
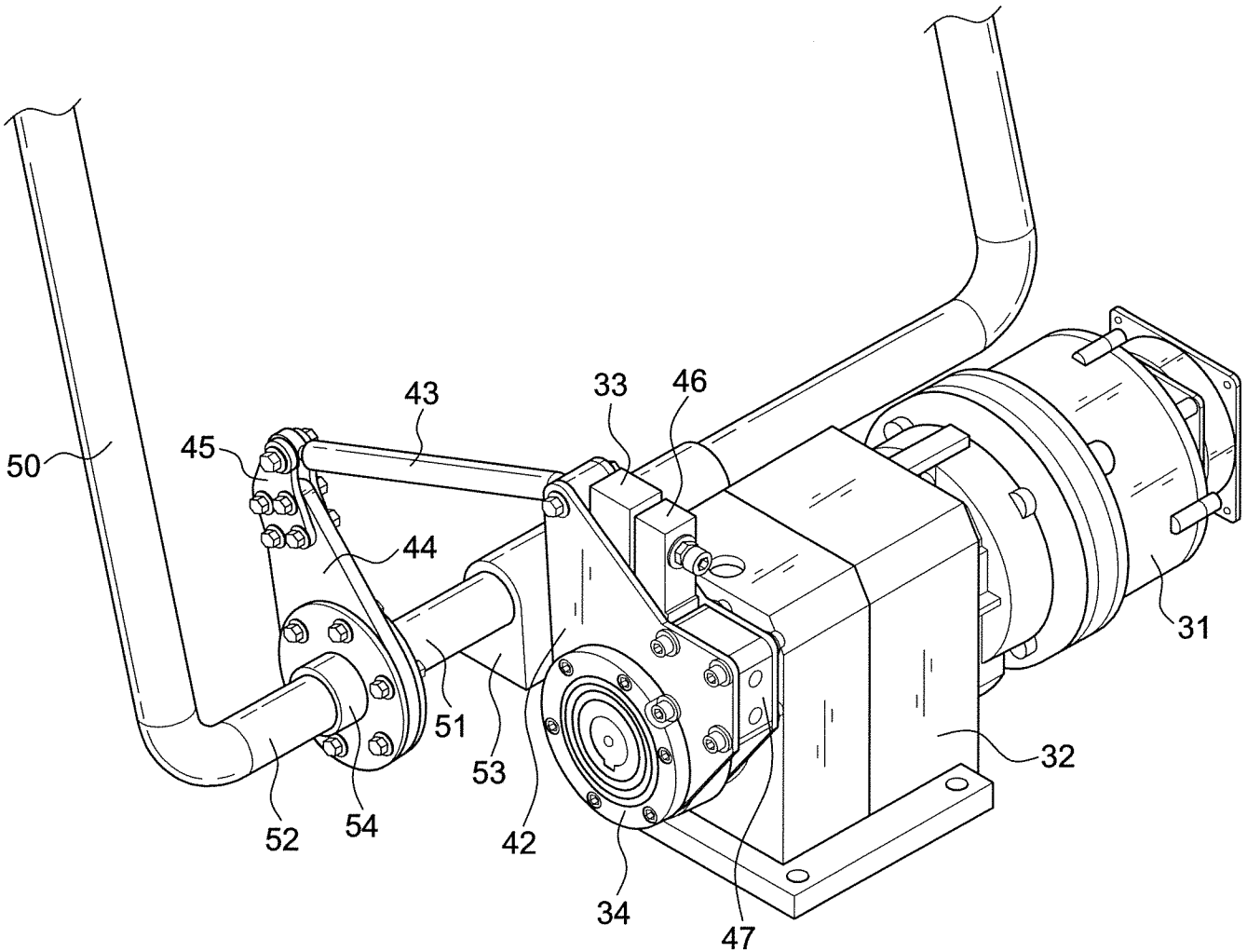
FIG. 4 is a perspective view of a preferred embodiment of the present invention.
Figure 5:
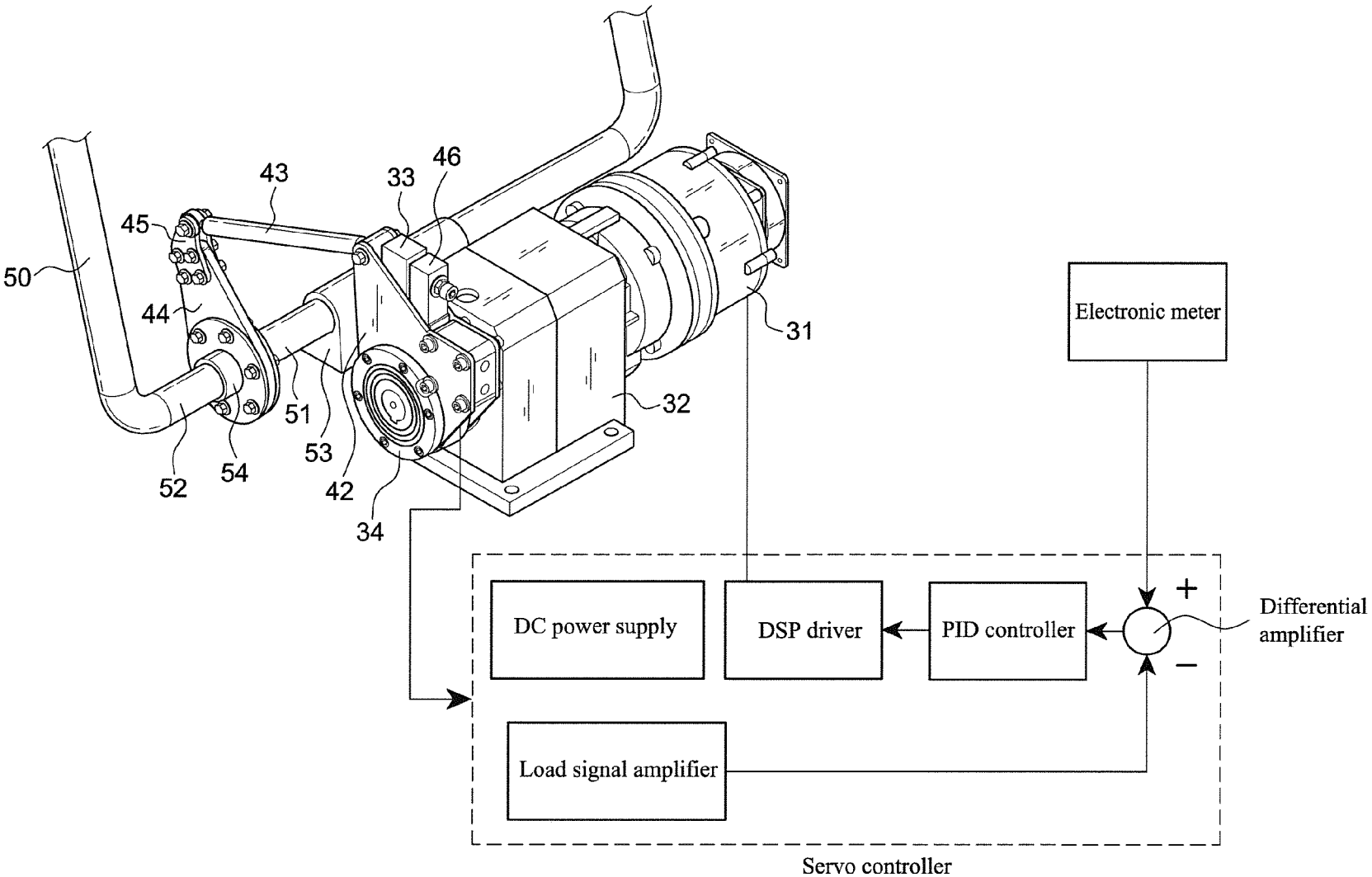
FIG. 5 is a circuit block diagram of the present invention.

A servo controller is primarily provided for comparing the difference between a sensed value of the beam-type load cell 46 and a set value of the electronic meter 70. After the difference value is adjusted by the electric current controller, an electric current is outputted to drive the motor 31. The circuit block diagram of the servo controller as shown in FIG. 5 includes a DC power supply, a load signal amplifier, a differential amplifier, a proportional-integral-derivative (PID) controller, and a DSP driver, and the sensed value of the beam-type load cell 46 is fed back to the load signal amplifier, and an amplified signal is transmitted to the differential amplifier. In addition, the set value of the electronic meter 70 is transmitted to the differential amplifier. Therefore, the differential amplifier compares the load signal of the beam-type load cell at the actual end with a desired value set by the electronic meter at a target end, and the difference value of the desired value and the target value is adjusted by the PID controller to drive the DSP driver to output an electric current to drive the motor, so that the servo controller will compare the difference between the actual load and the target setting from time to time, and correct the difference to output an electric current to drive the motor, such that the actual exercise load can be equal to the set value.

In summation of the description above, the present invention integrates a motor, a gear reduction box, a controller, a torque sensor and an electronic meter into a servo control system electromechanically and uses the resistance as the exercise load to substitute the traditional weights. The invention can be applied extensively in various strength training equipments with the advantages of a simple structure, a convenient operation, and a continuous benefit.

The present invention integrates the low-cost beam-type load cell with the link rod and arm to substitute the high-priced rotary type torque sensor, and the reliable durability and precision are not only applicable for general strength training, but also applicable for medical high-precision applications.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A strength training control device using a motor assembled beam-type load cell, comprising:

a) a base frame;

b) a torque source, fixed onto the base frame, and comprising a motor and a gear reduction box, wherein the motor is a brushless motor or a DC motor, and an end of the gear reduction box is coupled to the motor, and another end of the gear reduction box includes a main shaft;

c) a drive arm having a depressing surface at the top of the internal side of the top end thereof and a flange at each side of the bottom end thereof, the flange having at the center thereof a shaft hole for slipping over the main shaft;

d) an operating rod with the bottom pivotally coupled to the base frame and serving as a control element for training a muscle of a user;

e) a link mechanism including:

i) a rocker arm with the bottom portion thereof mounted onto the operating rod such that it is driven by the operating rod;

ii) a front and a rear plate each having a central hole at the bottom thereof, respectively, such that they are pivotally coupled to the flanges at both sides of the drive arm; and iii) a connecting rod with both ends pivotably and respectively coupled to the top of the rocker arm and the top of the front and rear plates, whereby, when the operating rod is activated, the rocker arm pulls or pushes the connecting rod to impart a rotary motion in the forward or the reverse direction to the front and rear plates;

f) a beam-type load cell secured to the side of the drive arm with one end thereof resting against the depressing surface, whereby, when the front and rear plates are reversely rotated, one end of the beam-type load cell rests against the drive arm to conduct a reverse rotation;

g) an electronic meter, fixed onto the base frame, and provided for a user to set a required torque value; and h) a servo controller, for comparing the difference between a sensed value of the beam-type load cell and a set value of the electronic meter and after the difference value is adjusted, an electric current is output to drive the motor;

wherein the torque produced by the motor is amplified by the gear reduction box to adjust the actual torque value to the desired set value; and wherein, when the user operating the operating rod, the beam-type load cell will be activated via the link mechanism to force it to conduct a reverse rotation on the drive arm such that the torque acts on the operating rod to create a load resistance and the muscle of the user is loaded by this resistance to achieve a desirable training effect.

2. The strength training control device using a motor assembled beam-type load cell as recited in claim 1, wherein the servo controller comprises: a DC power supply, a load signal amplifier, a differential amplifier, a proportional-integral-derivative (PID) controller, and a DSP driver, and the sensed value of the beam-type load cell is fed back to the load signal amplifier, and the signal is amplified and then transmitted to the differential amplifier, and the set value of the electronic meter is transmitted to the differential amplifier, and then after the differential amplifier compares the difference between the load and the set value, the difference value is adjusted by the PID controller to drive the DSP driver to output an electric current to drive the motor.

3. The strength training control device using a motor assembled beam-type load cell as recited in claim 2, further comprising a load fixing block which is secured between the front and rear plates by a plurality of screws, and wherein the bottom of the beam-type load cell is screwed on the load fixing block.

4. The strength training control device using a motor assembled beam-type load cell as recited in claim 3, wherein an adjusting screw is screwed to the top of the beam-type load cell in such a way that the end portion of the adjusting screw rests against the depressing surface of the drive arm.

5. The strength training control device using a motor assembled beam-type load cell as recited in claim 4, wherein a bearing block and a ball bearing fit into the central hole at the bottom of the front and rear plates, respectively, and wherein the bearing blocks are fixed by a plurality of screws onto the front and rear plates, and wherein the ball bearings are pivotably mounted on the flanges at both sides of the drive arm, and wherein a C-shaped retaining ring is positioned around the internal side of each flange to fix the ball bearing in place, whereby the front and rear plates are rotatably positioned on the flanges of the drive arm.

6. The strength training control device using a motor assembled beam-type load cell as recited in claim 5, wherein the operating rod is separable in a left and a right rod onto which two flanged bases are mounted, and wherein the rocker arm is interposed between these two flanged bases and fixed by a plurality of bolts and nuts in place such that the rocker arm may swing back and forth with the operating rod.

7. The strength training control device using a motor assembled beam-type load cell as recited in claim 6, wherein the rocker arm and the connecting rod are coupled by two cams which are fixed by a plurality of bolts and nuts in place.

8. The strength training control device using a motor assembled beam-type load cell as recited in claim 7, further comprising a rod holder by which the operating rod pivotably mounted on the base frame.

* * * * *